US011049454B1

(12) United States Patent
Lu

(10) Patent No.: US 11,049,454 B1
(45) Date of Patent: Jun. 29, 2021

(54) TFT PIXEL THRESHOLD VOLTAGE COMPENSATION CIRCUIT WITH DATA PROGRAMMING FROM DRAIN OF THE DRIVE TFT

(71) Applicant: Sharp Kabushiki Kaisha, Osaka (JP)

(72) Inventor: Tong Lu, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/941,892

(22) Filed: Jul. 29, 2020

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01)

(58) Field of Classification Search
CPC ... G09G 3/3233; G09G 3/3266; G09G 3/3291
See application file for complete search history.

(56) References Cited

U.S. PATENT DOCUMENTS 7,414,599 B2 8/2008 Chung et al.
8,237,637 B2 8/2012 Chung
10,529,284 B2 1/2020 Yang
2014/0320549 A1* 10/2014 Kumeta ..... G09G 3/3225 345/690
2019/0266953 A1 8/2019 Lee

* cited by examiner

*Primary Examiner* — Stacy Khoo
(74) *Attorney, Agent, or Firm* — Renner, Otto, Boisselle & Sklar LLP

(57) ABSTRACT

A pixel circuit for a display device provides enhanced performance by performing drain-side initialization and data programming with respect to the drive transistor. The pixel circuit is operable in an initialization phase, a combined threshold compensation and data programming phase, and an emission phase, the pixel circuit including a drive transistor configured to control an amount of current to a light-emitting device during the emission phase depending upon a voltage applied to a gate of the drive transistor, and the drive transistor having a first terminal and a second terminal with the first terminal being electrically connected during the emission phase to a first voltage supply line that supplies a driving voltage. The second terminal of the drive transistor is electrically connected to a data voltage supply line that supplies a data voltage during the initialization phase and the combined threshold compensation and data programming phase to compensate a threshold voltage of the drive transistor and to program the data voltage.

16 Claims, 4 Drawing Sheets

TFT PIXEL THRESHOLD VOLTAGE COMPENSATION CIRCUIT WITH DATA PROGRAMMING FROM DRAIN OF THE DRIVE TFT

TECHNICAL FIELD

The present application relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through a p-type drive transistor. In one example, an input signal, such as a low "SCAN" signal, is employed to switch transistors in the circuit to permit a data voltage, VDAT, to be stored at a storage capacitor during a programming phase. When the SCAN signal is high and the switch transistors isolate the circuit from the data voltage, the VDAT voltage is retained by the capacitor, and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{DD} - V_{TH})^2$$

where $V_{DD}$ is a power supply connected to the source of the drive transistor.

TFT device characteristics, especially the TFT threshold voltage $V_{TH}$, may vary with time or among comparable devices, for example due to manufacturing processes or stress and aging of the TFT device over the course of operation. With the same VDAT voltage, therefore, the amount of current delivered by the drive TFT could vary by a significant amount due to such threshold voltage variations. Therefore, pixels in a display may not exhibit uniform brightness for a given VDAT value.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor.

The threshold compensation time is decided by the drive transistor's characteristics, which may require a long compensation time for high compensation accuracy. For the data programming time, the RC constant time required for charging the programming capacitor is determinative of the programming time. As is denoted in the art, the one horizontal (1H) time is the time that it takes for the data to be programmed for one row.

With such circuit configuration, however, the anode of the OLED is not reset during the initialization and programming phases. Rather, there will be residual voltage at the OLED anode. When emission starts and the emission current flows through the OLED during the emission phase, the OLED will need some time to refresh the data voltage at the anode. A first problem with this is that the residual voltage may affect the true black state. For example, if the previous frame data voltage corresponds to a white grayscale and the current frame data voltage corresponds to a black grayscale, there will be some light emission due to the presence of the residual white grayscale voltage from the previous frame at the beginning of the current emission phase. The true black state thus will be compromised. A second problem is degradation of performance by memory effects from the previous frame data. If the programmed current for the current frame is a relatively low current, it could take a significant time to refresh the anode to the programmed value. During the refresh period, the light emission could vary due to the previous residual data at the anode of the OLED, which means the same programmed data could have different light emission as affected by the previous frame data.

Another approach is described in U.S. Pat. No. 8,237,637 (Bo-yong Chung, issued Aug. 7, 2012). A similar circuit is employed as in U.S. Pat. No. 7,414,599, and the memory effects are removed by adding one more transistor between the initialization voltage supply line and the anode. However, the initialization voltage supplies at least one row, and there could thousands of pixels in one row and thus a large current draw stems from the initialization voltage. The IR drop on the initialization supply line could affect the uniformity of emission.

Another approach is described in US 2019/0266953 (Takyoung LEE, published Aug. 29, 2019). In such circuit, a threshold voltage of the drive transistor is stored at a storage capacitor, and a data voltage signal is applied to the gate of the drive transistor through a programing capacitor. With this configuration, the positive power supply and the negative power supply have to change to the opposite power levels for initializing the pixel circuit, and this may consume more power.

Another approach is described in U.S. Ser. No. 10/529,284 (Gun Woo Yang, issued Jan. 7, 2020). In such circuit, a threshold voltage of the drive transistor is stored at a storage capacitor, and a data voltage signal is applied to the gate of the drive transistor through a programing capacitor. This configuration employs multiple levels for the positive power supply, and thus may consume more power.

SUMMARY OF INVENTION

The present application relates to pixel circuits that are capable of compensating the threshold voltage variations of the drive transistor. In embodiments of the present application, in contrast to conventional configurations, data programming is performed using the drain of the drive transistor rather than the gate or source of the drive transistor as is typical. A benefit of data programming from the drain side of the drive transistor is that this architecture removes a separate initialization voltage supply line. As the data is programmed one row at a time, and one column data voltage only supplies one pixel, the IR drop has substantially less impact on performance than using a separate initialization voltage as done in conventional configurations.

An aspect of the invention, therefore, is a pixel circuit for a display device that provides enhanced performance by performing drain-side initialization and data programming with respect to the drive transistor. In exemplary embodiments, the pixel circuit is operable in an initialization phase, a combined threshold compensation and data programming phase, and an emission phase, the pixel circuit including a drive transistor configured to control an amount of current to a light-emitting device during the emission phase depending upon a voltage applied to a gate of the drive transistor, the drive transistor having a first terminal and a second terminal with the first terminal being electrically connected during the emission phase to a first voltage supply line that supplies a driving voltage; a capacitor having a first plate that is electrically connected to the gate of the drive transistor during the emission phase and a second plate connected to the first terminal of the drive transistor; and a light-emitting device that is electrically connected at a first terminal to the second terminal of the drive transistor during the emission phase and is connected at a second terminal to a second voltage supply line. The second terminal of the drive transistor is electrically connected to a data voltage supply line that supplies a data voltage during the initialization phase and the combined threshold compensation and data programming phase to compensate a threshold voltage of the drive transistor and to program the data voltage.

In exemplary embodiments, the pixel circuit further includes a first switch transistor having a first terminal connected to the data voltage supply line, wherein the first switch transistor is placed in an on state during the initialization phase and the combined threshold compensation and data programming phase to electrically connect the second terminal of the drive transistor to the data voltage supply line. The first switch transistor has a second terminal connected to a node N1, and the pixel circuit further includes a second switch transistor having a first terminal connected to the gate of the drive transistor and a second terminal connected to the node N1; and a third switch transistor having a first terminal connected to the second terminal of the drive transistor and a second terminal connected to the node N1. The second and third switch transistors are placed in an on state during the initialization phase and the combined threshold compensation and data programming phase to electrically connect the second terminal of the drive transistor to the data voltage supply line, and to diode-connect the drive transistor by electrically connecting the gate of the drive transistor and the second terminal of the drive transistor.

Another aspect of the invention is a method of operating a pixel circuit in a manner that provides enhanced performance by performing drain-side initialization and data programming with respect to the drive transistor. In exemplary embodiments, the method of operating includes the steps of providing a pixel circuit in accordance with any of the embodiments; performing an initialization phase to initialize voltages within the pixel circuit and performing a combined threshold compensation and data programming phase to compensate a threshold voltage of the drive transistor and to program a data voltage, each of the initialization phase and the combined threshold compensation and data programming phase comprising: diode-connecting the drive transistor by electrically connecting a gate and the second terminal of the drive transistor; and electrically connecting the second terminal of the drive transistor to a data voltage supply line that supplies the data voltage to apply the data voltage to the second terminal of the drive transistor; and performing an emission phase during which light is emitted from the light-emitting device comprising: electrically connecting the first terminal of the drive transistor and the first power supply line; electrically connecting the gate of the drive transistor and the first plate of the capacitor; and electrically connecting the first terminal of the light-emitting device and the second terminal of the drive transistor to apply the driving voltage from the first voltage supply line to the light-emitting device through the drive transistor. In exemplary embodiments, the initialization phase further may include electrically disconnecting the first terminal of the light-emitting device from the first voltage supply line, and electrically connecting the first terminal of the light-emitting device to the data voltage supply line to apply the data voltage to the first terminal of the light-emitting device.

In exemplary embodiments of the method of operating, each of the initialization phase and the combined threshold compensation and data programming phase further may include placing the first switch transistor in an on state to electrically connect the second terminal of the drive transistor to the data voltage supply line through the first switch transistor. Each of the initialization phase and the combined threshold compensation and data programming phase further may include placing the second and third switch transistors in an on state to electrically connect the second terminal of the drive transistor to the data voltage supply line through the first and third switch transistors, and to diode-connect the drive transistor by electrically connecting the gate of the drive transistor and the second terminal of the drive transistor through the second and third switch transistors.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
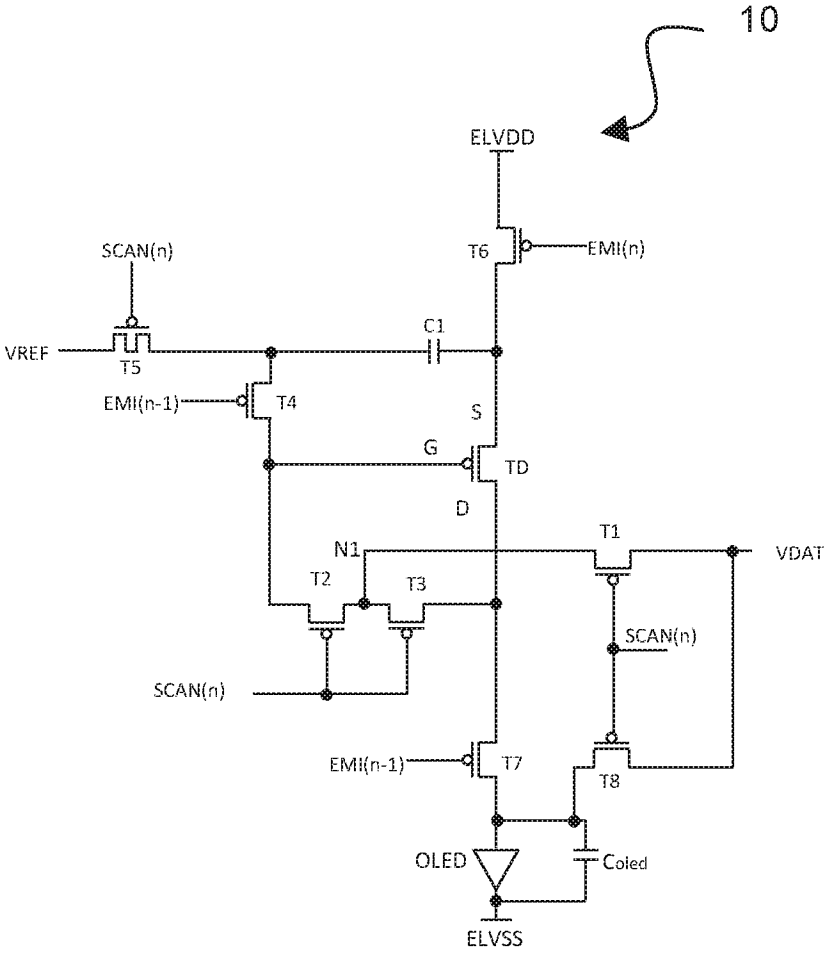
FIG. 1 is a drawing depicting a first circuit configuration in accordance with embodiments of the present application.

Embodiments of the present application will now be described with reference to the drawings, wherein like reference numerals are used to refer to like elements throughout. It will be understood that the figures are not necessarily to scale.

Figure 2:
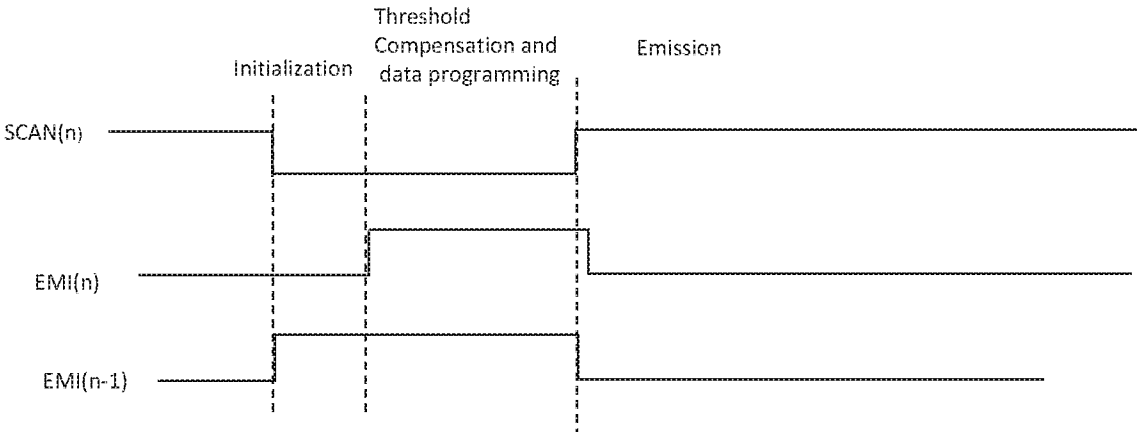
FIG. 2 is a drawing depicting a timing diagram associated with the operation of the circuit of FIG. 1.

FIG. 1 is a drawing depicting a first circuit configuration 10 in accordance with embodiments of the present application, and FIG. 2 is a timing diagram associated with the operation of the circuit configuration 10 of FIG. 1. In this example, the circuit 10 is configured as a thin film transistor (TFT) circuit that includes multiple p-type transistors TD and T1~T8, and one storage capacitor C1. The circuit elements drive a light-emitting device, such as for example an organic light-emitting device (OLED). The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 1 depicts the TFT circuit 10 configured with multiple p-type TFTs. TD is a drive transistor that is an analogue TFT with its gate, source, and drain indicated (G, S, D), and transistors T1-T8 are digital switch TFTs. In this example, T5 is depicted as a double gate transistor to minimize leakage from the storage capacitor C1, although a single gate transistor alternatively may be employed. As referenced above, C1 is storage capacitor. $C_{oled}$ is the internal capacitance of the OLED device (i.e., $C_{oled}$ is not a separate component, but is inherent to the OLED). The OLED further is connected to a power supply line that provides a power supply ELVSS as is conventional.

The OLED and the TFT circuit 10, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT circuit 10 (and subsequent embodiments) may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitors each may comprise a first electrode, an insulating layer and a second electrode, whereby the insulating layer forms an insulating barrier between the first and second electrodes. Wiring between components in the circuit, and wiring used to introduce signals to the circuit (e.g. SCAN, EMI, VDAT, VREF) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first terminal (e.g. anode of the OLED), which is connected to transistors T7 and T8 in this example, one or more layers for injecting or transporting charge (e.g. holes) to an emission layer, an emission layer, one or more layers for injecting or transporting electrical charge (e.g. electrons) to the emission layer, and a second terminal (e.g. cathode of the OLED), which is connected to power supply line ELVSS in this example. The injection layers, transport layers and emission layer may be organic materials, the first and second electrodes may be metals, and all of these layers may be deposited by a thermal evaporation technique.

Referring to the TFT circuit 10 of FIG. 1 in combination with the timing diagram of FIG. 2, the TFT circuit 10 operates to perform in three phases: an initialization phase, a combined threshold compensation and data programming phase, and an emission phase for light emission. Generally, this embodiment has comparable control signals EMI and SCAN for other rows of pixels in the overall or broader display device, thereby enabling fewer control signal wires in a display configuration as common control lines may be shared over different rows. For this example and in subsequent embodiments, display pixels are addressed by row and column. The current row is row n. The previous row is row n−1, and the second previous row is n−2. The next row is row n+1, and the row after that is row n+2, and so on for the various rows as they relate to the corresponding control signals identified in the figures. Accordingly, for example, SCAN(n) refers to the scan signal at row n, EMI(n) refers to the emission signal at row n, and EMI(n−1) refers to the emission signal at row n−1, and the like, and so on for the various control signals. In this manner, for the various embodiments the input signals correspond to the indicated rows.

As illustrated in the timing diagram of FIG. 2, in this first embodiment, during the previous emission phase the EMI(n) and EMI(n−1) signal levels have a low voltage value, so transistors T4, T6, and T7 are in an on state, and light emission is being driven by the input driving voltage ELVDD connected by a power supply line to the drive transistor TD, whereby the actual current applied to the OLED is determined by the voltage at the gate and the source of the drive transistor. The SCAN(n) signal levels for the applicable rows initially have a high voltage value so switch transistors T1, T2, T3, T5, and T8 are in an off state.

At the beginning of the initialization phase, the EMI(n−1) signal level is changed from a low voltage level to a high voltage level, causing the transistors T4 and T7 to be placed in the off state. The capacitor C1 has a first plate connected to switch transistors T4 and T5, and a second plate connected to a first terminal or source of the drive transistor. Switch transistor T4 has a first terminal connected to the first plate of the capacitor and a second terminal connected to the gate of the drive transistor. As transistor T4 is turned off, the gate of the drive transistor is electrically disconnected from the first plate of the capacitor C1. Switch transistor T7 has a first terminal connected to the first terminal (anode) of the light-emitting device and a second terminal connected to a second terminal or drain of the drive transistor. As transistor T7 is turned off, the anode of the light-emitting device is electrically disconnected from the drain of the drive transistor.

Also at the beginning of the initialization phase, the SCAN(n) signal level is changed from a high voltage value to a low voltage value, causing switch transistors T1, T2, T3, T5, and T8 to be placed in an on state. Switch transistor T5 has a first terminal connected to a reference voltage supply line that supplies a reference voltage VREF, and a second terminal connected to the first plate of the storage capacitor C1. As transistor T5 is turned on, the first plate of the capacitor is electrically connected to the reference voltage supply line and the reference voltage VREF is applied to the first plate of the capacitor C1 through T5. As the second plate of the capacitor C1 is electrically connected to the voltage supply line that supplies the driving voltage ELVDD through T6 as T6 is on from the previous emission phase, the charge of capacitor C1 is refreshed.

Switch transistor T1 has a first terminal connected to a data voltage supply line that supplies a data voltage VDAT, and a second terminal connected to a node N1 that is a connection of switch transistors T2 and T3. Switch transistor T2 has a first terminal connected to the gate of the drive transistor and a second terminal connected to the node N1. Switch transistor T3 has a first terminal connected to the second terminal (drain) of the drive transistor and a second terminal connected to the node N1. As transistor T1 is turned on, node N1 is electrically connected to the data voltage supply line and the data voltage VDAT is applied to the node N1 connection of T2 and T3 through T1. As transistor T2 is turned on the data voltage VDAT also is applied to the gate of the drive transistor TD through T2. As transistor T3 is turned on, the data voltage VDAT is also applied to the drain of the drive transistor TD through T3. With transistors T2 and T3 being turned on, the gate and drain of the drive transistor are electrically connected to each other through T2 and T3. The drive transistor is therefore referred to as being "diode-connected". Diode-connected refers to the drive transistor TD being operated with its gate and a second terminal (e.g., source or drain) being electrically connected, such that current flows in one direction.

Switch transistor T8 has a first terminal connected to the data voltage supply line and a second terminal connected to the first terminal (anode) of the light-emitting device. As transistor T8 is turned on, the anode of the light-emitting device is electrically connected to the data voltage supply line and the data voltage VDAT also is applied to the anode of the light emitting device through T8. The data voltage is set to a voltage that is low enough so that the light emission caused by the data voltage being applied to the anode of the light-emitting device is lower than the light emission during the emission phase. In this manner, the voltages at the gate of the drive transistor, the light-emitting device, and across the capacitor C1, are initialized during the initialization phase. The initialization phase thereby operates to eliminate memory effects from previous frames.

The TFT circuit 10 next is operable in a combined threshold compensation and data programming phase, during which the threshold voltage of the drive transistor TD is compensated and stored in the storage capacitor C1, and the data voltage VDAT also is programmed. Switch transistor T6 has a first terminal connected to the voltage supply line that supplies the driving voltage ELVDD and a second terminal connected to first terminal (source) of the drive transistor and the second plate of the storage capacitor C1. At the beginning of the combined threshold compensation and data programming phase, the EMI(n) signal level is changed from a low voltage value to a high voltage value, causing transistor T6 to be placed in an off state. As the transistor T6 is turned off, the source of the drive transistor and the second plate of the capacitor C1 are electrically disconnected from voltage supply line that supplies ELVDD, and the source of the drive transistor becomes floating.

As the diode-connected gate-drain of the drive transistor is electrically connected to the data voltage supply line VDAT, the source voltage of the drive transistor will be pulled down from an initial voltage ELVDD towards $V_{DAT}+|V_{TH}|$, where $V_{TH}$ is the threshold voltage of the drive transistor. Preferably, to have effective voltage threshold compensation of the drive transistor TD, the initial voltage difference between the source of the drive transistor and the diode-connected gate-drain of the drive transistor should satisfy the following condition:

$$V_{ELVDD}-V_{DAT}>|V_{TH}|+\Delta V,$$

where ΔV is a voltage that is large enough to generate a high initial current to charge the storage capacitor within an allocated threshold compensation time. The value of ΔV will depend on the properties of the transistors. For example, ΔV would be at least 3 volts for exemplary low-temperature polycrystalline silicon thin film transistor processes. The data voltage VDAT is set to satisfy this voltage requirement.

At the end of the combined threshold compensation and data programming phase, the threshold voltage $|V_{TH}|$ and the data voltage VDAT are stored at capacitor C1. The voltage level at the second plate of the capacitor is $V_{DAT}|V_{TH}|$. The voltage level at the first plate of the storage capacitor C1 is $V_{REF}$. At the end of the combined threshold compensation and data programming phase, the SCAN(n) signal level is changed from a low voltage level to a high voltage level, causing the transistors T1, T2, T3, T5, and T8 to be placed in the off state. As transistor T5 is turned off, the reference voltage supply line that supplies VREF is electrically disconnected from a first plate of the capacitor C1. As transistor T1 is turned off, the data voltage supply line that supplies VDAT is electrically disconnected from the node N1 connection of transistors T3 and T2. As transistor T2 is turned off, the gate of the drive transistor TD is disconnected from the data voltage supply line VDAT, and the gate of the drive transistor becomes floating. As transistor T3 is turned off, the drain of the drive transistor TD is disconnected from the data voltage supply line VDAT, and the drive transistor is also no longer diode-connected as T3 and T2 are off which electrically disconnects the gate and drain of the drive transistor. As transistor T8 is turned off, the data voltage supply line VDAT also is electrically disconnected from the anode of the light-emitting device.

The TFT circuit 10 next is operable in an emission phase during which the OLED is capable of emitting light. Switch transistor T7 has a first terminal connected to the second terminal (drain) of the drive transistor and a second terminal connected to the first terminal (anode) of the light emitting device. The EMI(n−1) signal is changed from the high voltage value to the low voltage value, causing transistors T4 and T7 to be placed in the on state. As transistor T4 is turned on, the gate of the drive transistor is electrically connected to the first plate of the capacitor C1 through T4. Ignoring any parasitic capacitance as being negligible, the voltage across the capacitor C1 is $V_{DAT}+|V_{TH}|-V_{REF}$, and such voltage is applied to the gate and the source of the drive transistor. As transistor T7 is turned on, the anode of the light emitting device is electrically connected to the drain of the drive transistor through T7. Next during the emission phase, the EMI(n) signal is changed from the high voltage value to the low voltage value, causing transistor T6 to be turned on, and the source of the drive transistor is electrically connected to the voltage supply line that supplies the driving voltage ELVDD. The current that flows through the OLED is:

$$I_{OLED}=\frac{\beta}{2}(V_{DAT}+|V_{TH}|-V_{REF})^2$$

where $$\beta=\mu_n\cdot C_{ox}\cdot\frac{W}{L},$$

$C_{ox}$ is the capacitance of the drive transistor gate oxide;
W is the width of the drive transistor channel;
L is the length of the drive transistor channel (i.e. distance between source and drain); and
$\mu_n$ is the carrier mobility of the drive transistor.

Accordingly, the current to the OLED does not depend on the threshold voltage of the drive transistor TD, and thus the threshold voltage of the drive transistor is compensated.

With the configuration of the pixel circuit in accordance with embodiments of the present application, in contrast to conventional configurations, initialization and data programming are performed using the drain of the drive transistor rather than the gate or source of the drive transistor as is typical. A benefit of initialization and data programming from the drain side of the drive transistor is that this architecture removes a separate initialization voltage supply line by employing the data voltage supply line to also perform initialization. Normally, an initialization voltage supplies all the pixels in one row. There could be thus be a large current draw during the initialization phase, and this results in a large IR drop that degrades performance. In particular, the actual initialization states of different pixels could depend on the location of a given pixel within the pixel array, which can have an undesirable effect of undermining uniformity of performance. By using the data voltage supply line for initialization in accordance with embodiments of the present application, as each column data line only supplies one pixel at a time, there will be a substantially less IR drop as compared to conventional configurations that employ an additional and separate initialization voltage supply line.

Figure 3:
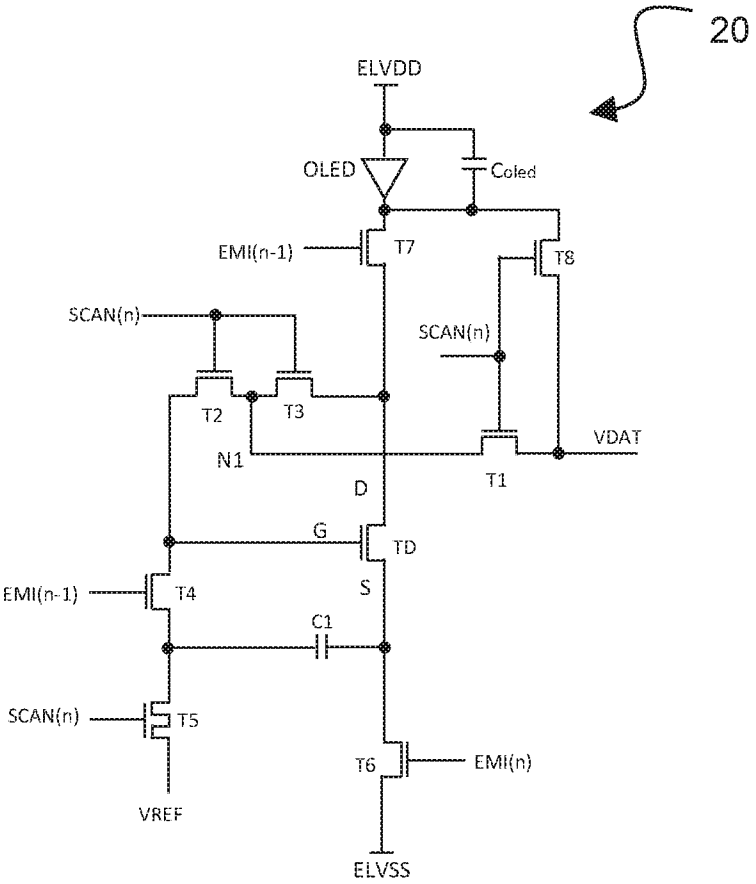
FIG. 3 is a drawing depicting a second circuit configuration in accordance with embodiments of the present application.
Figure 4:
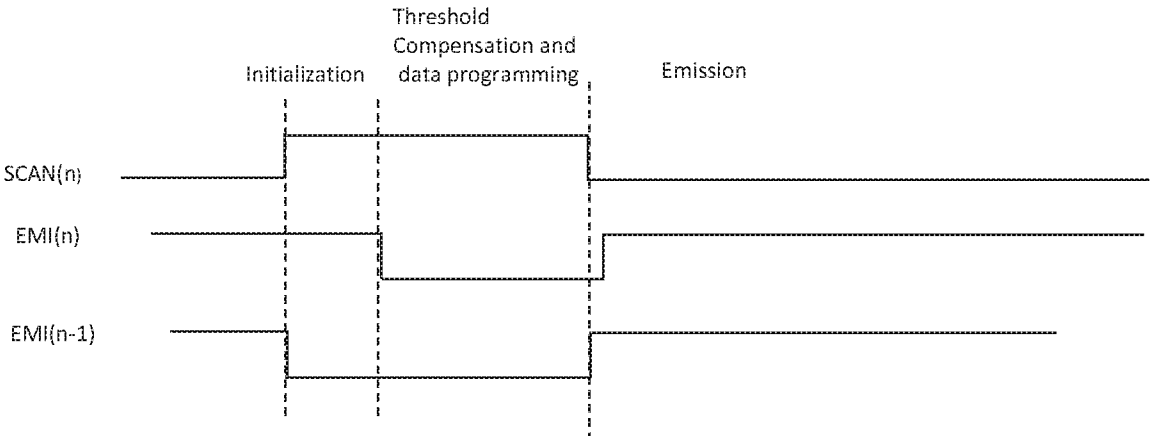
FIG. 4 is a drawing depicting a timing diagram associated with the operation of the circuit of FIG. 3.

FIG. 3 is a drawing depicting a second circuit configuration 20 in accordance with embodiments of the present application, and FIG. 4 is a timing diagram associated with the operation of the circuit configuration 20 of FIG. 3. The circuit configuration 20 of FIG. 3 operates comparably as the circuit configuration 10 of FIG. 1, except that the circuit configuration 20 employs n-type transistors rather than p-type transistors. As is known in the art, the drive properties of an OLED may be more suitable for one or other of p-type versus n-type transistors, and the principles of the present application are applicable to either type of configuration. Accordingly, in this example, the circuit 20 is configured as a thin film transistor (TFT) circuit that includes multiple n-type transistors TD and T1-T8 and one storage capacitor C1. The circuit elements drive a light-emitting device, such as for example an OLED. The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 3 depicts the TFT circuit 20 configured with multiple n-type TFTs. TD is a drive transistor that is an analogue TFT with its gate, source, and drain indicated (G, S, D), and transistors T1-T8 are digital switch TFTs. In this example, T5 also is depicted as a double gate transistor to minimize leakage from the storage capacitor C1, although a single gate transistor alternatively may be employed. As referenced above, C1 is storage capacitor. $C_{oled}$ is the internal capacitance of the OLED device (i.e., $C_{oled}$ is not a separate component, but is inherent to the OLED). The OLED further is connected to a power supply line that provides a power supply ELVDD as is conventional.

The control signal levels depicted in the timing diagram of FIG. 4 are basically comparable to the control signal levels depicted in the timing diagram of FIG. 2, except modified as warranted for the operation of n-type transistors rather than p-type transistors. In this second embodiment, during the previous emission phase, the EMI(n) and EMI (n−1) signal levels have a high voltage value, so transistors T4, T6, and T7 are in an on state, and light emission is being driven by the input driving voltage ELVSS connected to the drive transistor TD, whereby the actual current applied to the OLED is determined by the voltage at the gate and the source of the drive transistor. The SCAN(n) signal levels for the applicable rows initially have a low voltage value so transistors T1, T2, T3, T5, and T8 are in an off state.

Referring to the TFT circuit 20 of FIG. 3 in combination with the timing diagram of FIG. 4, similarly as the previous embodiment the TFT circuit 20 operates to perform in three phases: an initialization phase, a combined threshold compensation and data programming phase, and an emission phase for light emission. At the beginning of the initialization phase, the EMI(n−1) signal level is changed from the high voltage level to a low voltage level, causing the switch transistors T4 and T7 to be placed in the off state. As transistor T4 is turned off, the gate of the drive transistor is electrically disconnected from the first plate of the capacitor C1. As transistor T7 is turned off, the first terminal (cathode in this embodiment) of the light-emitting device is electrically disconnected from the drain of the drive transistor.

The SCAN(n) signal level is changed from a low voltage value to a high voltage value, causing switch transistors T1, T2, T3, T5, and T8 to be placed in the on state. As transistor T5 is turned on, the reference voltage supply line is electrically connected to the first plate of the capacitor C1 and the reference voltage VREF is applied to the first plate of the capacitor C1 through T5. As the second plate of the capacitor C1 is electrically connected to the voltage supply line ELVSS through T6 being on from the previous emission phase, the charge of capacitor C1 is refreshed. As transistor T1 is turned on, the data voltage supply line is electrically connected to the node N1 and the data voltage VDAT is applied to the node N1 connection of transistors T3 and T2 through T1. As transistor T2 is turned on, the data voltage VDAT also applied to the gate of the drive transistor TD. As transistor T3 is turned on, the data voltage VDAT also is applied to the drain of the drive transistor TD. The drive transistor is also diode-connected with its gain and drain electrically connected through T2 and T3 with T2 and T3 being on. As transistor T8 is turned on, the first terminal (cathode) of the light-emitting device is electrically connected to the data voltage supply line and the data voltage VDAT is also applied to the first terminal (cathode) of the light emitting device. The data voltage is set to a voltage that is high enough so that light emission caused by the data voltage applied to the cathode of the light-emitting device is lower than the light emission during the emission phase.

The TFT circuit 20 next is operable in a combined threshold compensation and data programming phase, during which the threshold voltage of the drive transistor TD is compensated and stored in the storage capacitor C1, and the data voltage VDAT also is programmed. At the beginning of the combined threshold compensation and data programming phase, the EMI(n) signal level is changed from a high voltage value to a low voltage value, causing transistor T6 to be placed in the off state. As the transistor T6 is turned off, the first terminal (source) of the drive transistor and the second plate of the capacitor C1 are electrically disconnected from the power supply ELVSS, and the source of the drive transistor becomes floating.

As the diode-connected gate-drain of the drive transistor is electrically connected to the data voltage supply line VDAT, the source voltage of the drive transistor will be pulled up from initial voltage ELVSS towards $V_{DAT}-V_{TH}$, where $V_{TH}$ is the threshold voltage of the drive transistor. Preferably, to have effective voltage threshold compensation of the drive transistor TD, the initial voltage difference between the source of the drive transistor and the diode-connected gate-drain of the drive transistor should satisfy the following condition:

$$V_{DAT}-V_{ELVSS}>V_{TH}+\Delta V,$$

where ΔV is a voltage that is large enough to generate a high initial current to charge the storage capacitor within an allocated threshold compensation time. The value of ΔV will depend on the properties of the transistors. For example, ΔV would be at least 3 volts for exemplary low-temperature polycrystalline silicon thin film transistor processes. The data voltage VDAT is set to satisfy this voltage requirement.

At the end of the combined threshold compensation and data programming phase, the threshold voltage $V_{TH}$ and the data voltage VDAT are stored at capacitor C1. The voltage level at the second plate of the capacitor is $V_{DAT}-V_{TH}$. The voltage level at the first plate of the capacitor is $V_{REF}$. At the end of the combined threshold compensation and data programming phase, the SCAN(n) signal level is changed from a high voltage level to a low voltage level, causing the transistors T1, T2, T3, T5, and T8 to be placed in the off state. As transistor T5 is turned off, the reference voltage supply line VREF is electrically disconnected from the first plate of the capacitor C1. As transistor T1 is turned off, the data voltage supply line VDAT is electrically disconnected from the node N1 connection of transistors T3 and T2. As transistor T2 is turned off, the gate of the drive transistor TD is electrically disconnected from the data voltage supply line VDAT, and the gate of the drive transistor becomes floating. As transistor T3 is turned off, the drain of the drive transistor TD is electrically disconnected from the data voltage supply line VDAT, and the drive transistor is also no longer diode-connected as T3 and T2 are off thereby electrically disconnecting the gate and drain of the drive transistor from each other. As transistor T8 is turned off, the data voltage supply line VDAT also is electrically disconnected from the first terminal (cathode) of the light-emitting device.

The TFT circuit 20 next is operable in an emission phase during which the OLED is capable of emitting light. The EMI(n−1) signal is changed from the low voltage value to the high voltage value, causing transistors T4 and T7 to be placed in the on state. As transistor T4 is turned on, the gate of the drive transistor is electrically connected to the first plate of the capacitor C1. Ignoring the parasitic capacitance as negligible, the voltage across the capacitor C1, $V_{DAT}-V_{TH}-V_{REF}$, is applied to the gate and the first terminal (source) of the drive transistor. As transistor T7 is turned on, the cathode of the light-emitting device is electrically connected to the second terminal (drain) of the drive transistor through T7. Next, the EMI(n) signal is changed from the low voltage value to the high voltage value, causing transistor T6 to be placed in the on state, and the source of the drive transistor is electrically connected to the power supply ELVSS through T6. The current that flows through the OLED is:

$$I_{OLED}=\frac{\beta}{2}(V_{DAT}-V_{TH}-V_{REF})^2$$

where $$\beta=\mu_n\cdot C_{ox}\cdot\frac{W}{L},$$

$C_{ox}$ is the capacitance of the drive transistor gate oxide;
W is the width of the drive transistor channel;
L is the length of the drive transistor channel (i.e. distance between source and drain); and
$\mu_n$ is the carrier mobility of the drive transistor.

Accordingly, the current to the OLED does not depend on the threshold voltage of the drive transistor TD, and thus the threshold voltage of the drive transistor is compensated. Similarly as in the previous embodiment, the circuit configuration 20 also employs initialization and data programming using the drain of the drive transistor rather than the gate or source of the drive transistor as is typical. Again, initialization and data programming from the drain side of the drive transistor removes a separate initialization voltage supply line by employing the data voltage supply line to perform initialization as well as data programming. There likewise will be a substantially less IR drop as compared to conventional configurations that employ an additional and separate initialization voltage supply line, and thus the degradation of uniformity experienced in conventional configurations is eliminated.

An aspect of the invention, therefore, is a pixel circuit for a display device that provides enhanced performance by performing drain-side initialization and data programming with respect to the drive transistor. In exemplary embodiments, the pixel circuit is operable in an initialization phase, a combined threshold compensation and data programming phase, and an emission phase, the pixel circuit including a drive transistor configured to control an amount of current to a light-emitting device during the emission phase depending upon a voltage applied to a gate of the drive transistor, the drive transistor having a first terminal and a second terminal with the first terminal being electrically connected during the emission phase to a first voltage supply line that supplies a driving voltage; a capacitor having a first plate that is electrically connected to the gate of the drive transistor during the emission phase and a second plate connected to the first terminal of the drive transistor; and a light-emitting device that is electrically connected at a first terminal to the second terminal of the drive transistor during the emission phase and is connected at a second terminal to a second voltage supply line. The second terminal of the drive transistor is electrically connected to a data voltage supply line that supplies a data voltage during the initialization phase and the combined threshold compensation and data programming phase to compensate a threshold voltage of the drive transistor and to program the data voltage. The pixel circuit may include one or more of the following features, either individually or in combination.

In an exemplary embodiment of the pixel circuit, the pixel circuit further includes a first switch transistor having a first terminal connected to the data voltage supply line, wherein the first switch transistor is placed in an on state during the initialization phase and the combined threshold compensation and data programming phase to electrically connect the second terminal of the drive transistor to the data voltage supply line.

In an exemplary embodiment of the pixel circuit, the first switch transistor has a second terminal connected to a node N1, and the pixel circuit further comprises: a second switch transistor having a first terminal connected to the gate of the drive transistor and a second terminal connected to the node N1; and a third switch transistor having a first terminal connected to the second terminal of the drive transistor and a second terminal connected to the node N1; wherein the second and third switch transistors are placed in an on state during the initialization phase and the combined threshold compensation and data programming phase to electrically connect the second terminal of the drive transistor to the data voltage supply line, and to diode-connect the drive transistor by electrically connecting the gate of the drive transistor and the second terminal of the drive transistor.

In an exemplary embodiment of the pixel circuit, the pixel circuit further includes a fourth switch transistor having a first terminal connected to the first plate of the capacitor and a second terminal connected to the gate of the drive transistor, wherein the fourth switch transistor is placed in an on state to electrically connect the gate of the drive transistor to the first plate of the capacitor.

In an exemplary embodiment of the pixel circuit, the pixel circuit further includes a fifth switch transistor having a first terminal connected to a reference voltage supply line that supplies a reference voltage and a second terminal connected to the first plate of the capacitor, wherein the fifth switch transistor is placed in an on state to electrically connect the reference voltage supply line to the first plate of the capacitor to apply the reference voltage to the capacitor.

In an exemplary embodiment of the pixel circuit, the pixel circuit further includes a sixth switch transistor having a first terminal connected to the first voltage supply line and a second terminal connected to the first terminal of the drive transistor, wherein the sixth switch transistor is placed in an on state to electrically connect the first voltage supply line to the first terminal of the drive transistor.

In an exemplary embodiment of the pixel circuit, the pixel circuit further includes a seventh switch transistor having a first terminal connected to the first terminal of the light-emitting device and a second terminal connected to the second terminal of the drive transistor, wherein the seventh switch transistor is placed in an on state to electrically connect the first terminal of the light-emitting device to the second terminal of the drive transistor.

In an exemplary embodiment of the pixel circuit, the pixel circuit further includes an eighth switch transistor having a first terminal connected to the data voltage supply line and a second terminal connected to the first terminal of the light-emitting device, wherein the eighth switch transistor is placed in an on state to electrically connect the data voltage supply line to the first terminal of the light-emitting device.

In an exemplary embodiment of the pixel circuit, the transistors are p-type transistors and the first terminal of the light-emitting device is an anode.

In an exemplary embodiment of the pixel circuit, the transistors are n-type transistors and the first terminal of the light-emitting device is a cathode.

In an exemplary embodiment of the pixel circuit, the light-emitting device is one of an organic light-emitting diode, a micro light-emitting diode (LED), or a quantum dot LED.

Another aspect of the invention is a method of operating a pixel circuit in a manner that provides enhanced performance by performing drain-side initialization and data programming with respect to the drive transistor. In exemplary embodiments, the method of operating includes the steps of providing a pixel circuit in accordance with any of the embodiments; performing an initialization phase to initialize voltages within the pixel circuit and performing a combined threshold compensation and data programming phase to compensate a threshold voltage of the drive transistor and to program a data voltage, each of the initialization phase and the combined threshold compensation and data programming phase comprising: diode-connecting the drive transistor by electrically connecting a gate and the second terminal of the drive transistor; and electrically connecting the second terminal of the drive transistor to a data voltage supply line that supplies the data voltage to apply the data voltage to the second terminal of the drive transistor; and performing an emission phase during which light is emitted from the light-emitting device comprising: electrically connecting the first terminal of the drive transistor and the first power supply line; electrically connecting the gate of the drive transistor and the first plate of the capacitor; and electrically connecting the first terminal of the light-emitting device and the second terminal of the drive transistor to apply the driving voltage from the first voltage supply line to the light-emitting device through the drive transistor. The method of operating may include one or more of the following features, either individually or in combination.

In an exemplary embodiment of the method of operating, the initialization phase further comprises electrically disconnecting the first terminal of the light-emitting device from the first voltage supply line, and electrically connecting the first terminal of the light-emitting device to the data voltage supply line to apply the data voltage to the first terminal of the light-emitting device.

In an exemplary embodiment of the method of operating, each of the initialization phase and the combined threshold compensation and data programming phase further comprises placing the first switch transistor in an on state to electrically connect the second terminal of the drive transistor to the data voltage supply line through the first switch transistor.

In an exemplary embodiment of the method of operating, the first switch transistor has a second terminal connected to a node N1; and the pixel circuit further comprises a second switch transistor having a first terminal connected to the gate of the drive transistor and a second terminal connected to the node N1, and a third switch transistor having a first terminal connected to the second terminal of the drive transistor and a second terminal connected to the node N1; and each of the initialization phase and the combined threshold compensation and data programming phase further comprises placing the second and third switch transistors in an on state to electrically connect the second terminal of the drive transistor to the data voltage supply line through the first and third switch transistors, and to diode-connect the drive transistor by electrically connecting the gate of the drive transistor and the second terminal of the drive transistor through the second and third switch transistors.

In an exemplary embodiment of the method of operating, the emission phase further comprises placing the fourth switch transistor in an on state to electrically connect the gate of the drive transistor and the first plate of the storage capacitor through the fourth switch transistor.

In an exemplary embodiment of the method of operating, each of the initialization phase and the combined threshold compensation and data programming phase further comprises placing the fifth switch transistor in an on state to electrically connect the reference voltage supply line to the first plate of the capacitor to apply the reference voltage to the first plate of the capacitor through the fifth switch transistor.

In an exemplary embodiment of the method of operating, the emission phase further comprises placing the sixth switch transistor in an on state to electrically connect the first voltage supply line to the first terminal of the drive transistor through the sixth switch transistor.

In an exemplary embodiment of the method of operating, the emission phase further comprises placing the seventh switch transistor in an on state to electrically connect the first terminal of the light-emitting device to the second terminal of the drive transistor through the seventh switch transistor.

In an exemplary embodiment of the method of operating, each of the initialization phase and the combined threshold compensation and data programming phase further comprises placing the eighth switch transistor in an on state to electrically connect the data voltage supply line to the first terminal of the light-emitting device.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present invention are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—first circuit configuration
20—second circuit configuration
TD—drive transistor
T1-T8—multiple switch transistors
OLED—organic light emitting diode (or generally light-emitting device)
C1—storage capacitor
$C_{oled}$—internal capacitance of OLED
VDAT—data voltage and data voltage supply line
ELVSS—power supply
ELVDD—power supply
VREF—reference voltage and reference voltage supply line
SCAN/EMI—control signals

What is claimed is:

1. A pixel circuit for a display device operable in an initialization phase, a combined threshold compensation and data programming phase, and an emission phase, the pixel circuit comprising:

a drive transistor configured to control an amount of current to a light-emitting device during the emission phase depending upon a voltage applied to a gate of the drive transistor, the drive transistor having a first terminal and a second terminal with the first terminal being electrically connected during the emission phase to a first voltage supply line that supplies a driving voltage;

a capacitor having a first plate that is electrically connected to the gate of the drive transistor during the emission phase and a second plate connected to the first terminal of the drive transistor;

a light-emitting device that is electrically connected at a first terminal to the second terminal of the drive transistor during the emission phase and is connected at a second terminal to a second voltage supply line;

wherein the second terminal of the drive transistor is electrically connected to a data voltage supply line that supplies a data voltage during the initialization phase and the combined threshold compensation and data programming phase to compensate a threshold voltage of the drive transistor and to program the data voltage; and a first switch transistor having a first terminal connected to the data voltage supply line, wherein the first switch transistor is placed in an on state during the initialization phase and the combined threshold compensation and data programming phase to electrically connect the second terminal of the drive transistor to the data voltage supply line;

wherein the first switch transistor has a second terminal connected to a node (N1), and the pixel circuit further comprises:

a second switch transistor having a first terminal connected to the gate of the drive transistor and a second terminal connected to the node (N1); and a third switch transistor having a first terminal connected to the second terminal of the drive transistor and a second terminal connected to the node (N1);

wherein the second and third switch transistors are placed in an on state during the initialization phase and the combined threshold compensation and data programming phase to electrically connect the second terminal of the drive transistor to the data voltage supply line, and to diode-connect the drive transistor by electrically connecting the gate of the drive transistor and the second terminal of the drive transistor.

2. The pixel circuit of claim 1, further comprising a fourth switch transistor having a first terminal connected to the first plate of the capacitor and a second terminal connected to the gate of the drive transistor, wherein the fourth switch transistor is placed in an on state to electrically connect the gate of the drive transistor to the first plate of the capacitor.

3. The pixel circuit of claim 2, further comprising a fifth switch transistor having a first terminal connected to a reference voltage supply line that supplies a reference voltage and a second terminal connected to the first plate of the capacitor, wherein the fifth switch transistor is placed in an on state to electrically connect the reference voltage supply line to the first plate of the capacitor to apply the reference voltage to the capacitor.

4. The pixel circuit of claim 3, further comprising a sixth switch transistor having a first terminal connected to the first voltage supply line and a second terminal connected to the first terminal of the drive transistor, wherein the sixth switch transistor is placed in an on state to electrically connect the first voltage supply line to the first terminal of the drive transistor.

5. The pixel circuit of claim 4, further comprising a seventh switch transistor having a first terminal connected to the first terminal of the light-emitting device and a second terminal connected to the second terminal of the drive transistor, wherein the seventh switch transistor is placed in an on state to electrically connect the first terminal of the light-emitting device to the second terminal of the drive transistor.

6. The pixel circuit of claim 5, further comprising an eighth switch transistor having a first terminal connected to the data voltage supply line and a second terminal connected to the first terminal of the light-emitting device, wherein the eighth switch transistor is placed in an on state to electrically connect the data voltage supply line to the first terminal of the light-emitting device.

7. The pixel circuit of claim 1, wherein the drive transistor is a p-type transistor and the first terminal of the light-emitting device is an anode.

8. The pixel circuit of claim 1, wherein the drive transistor is an n-type transistor and the first terminal of the light-emitting device is a cathode.

9. The pixel circuit of claim 1, wherein the light-emitting device is one of an organic light-emitting diode, a micro light-emitting diode (LED), or a quantum dot LED.

10. A method of operating a pixel circuit for a display device comprising the steps of:

providing the pixel circuit comprising:

a drive transistor configured to control an amount of current to a light-emitting device during an emission phase depending upon a voltage applied to a gate of the drive transistor, the drive transistor having a first terminal and a second terminal with the first terminal being electrically connectable to a first voltage supply line that supplies a driving voltage;

a capacitor having a first plate that is electrically connectable to the gate of the drive transistor and a second plate connected to the first terminal of the drive transistor; and a light-emitting device that is electrically connectable at a first terminal to the second terminal of the drive transistor and is connected at a second terminal to a second voltage supply line;

performing an initialization phase to initialize voltages within the pixel circuit and performing a combined threshold compensation and data programming phase to compensate a threshold voltage of the drive transistor and to program a data voltage, each of the initialization phase and the combined threshold compensation and data programming phase comprising:

diode-connecting the drive transistor by electrically connecting a gate and the second terminal of the drive transistor; and electrically connecting the second terminal of the drive transistor to a data voltage supply line that supplies the data voltage to apply the data voltage to the second terminal of the drive transistor; and performing an emission phase during which light is emitted from the light-emitting device comprising:

electrically connecting the first terminal of the drive transistor and the first voltage supply line;

electrically connecting the gate of the drive transistor and the first plate of the capacitor; and electrically connecting the first terminal of the light-emitting device and the second terminal of the drive transistor to apply the driving voltage from the first voltage supply line to the light-emitting device through the drive transistors;

wherein:

the initialization phase further comprises electrically disconnecting the first terminal of the light-emitting device from the first voltage supply line, and electrically connecting the first terminal of the light-emitting device to the data voltage supply line to apply the data voltage to the first terminal of the light-emitting device;

the pixel circuit further comprises a first switch transistor having a first terminal connected to the data voltage supply line; and each of the initialization phase and the combined threshold compensation and data programming phase further comprises placing the first switch transistor in an on state to electrically connect the second terminal of the drive transistor to the data voltage supply line through the first switch transistor.

11. The method of operating of claim 10, wherein the first switch transistor has a second terminal connected to a node (N1); and the pixel circuit further comprises a second switch transistor having a first terminal connected to the gate of the drive transistor and a second terminal connected to the node (N1), and a third switch transistor having a first terminal connected to the second terminal of the drive transistor and a second terminal connected to the node (N1); and each of the initialization phase and the combined threshold compensation and data programming phase further comprises placing the second and third switch transistors in an on state to electrically connect the second terminal of the drive transistor to the data voltage supply line through the first and third switch transistors, and to diode-connect the drive transistor by electrically connecting the gate of the drive transistor and the second terminal of the drive transistor through the second and third switch transistors.

12. The method of operating of claim 11, wherein the pixel circuit further comprises a fourth switch transistor having a first terminal connected to the first plate of the storage capacitor and a second terminal connected to the gate of the drive transistor; and the emission phase further comprises placing the fourth switch transistor in an on state to electrically connect the gate of the drive transistor and the first plate of the storage capacitor through the fourth switch transistor.

13. The method of operating of claim 12, wherein the pixel circuit further comprises a fifth switch transistor having a first terminal connected to a reference voltage supply line that supplies a reference voltage and a second terminal connected to the first plate of the capacitor; and each of the initialization phase and the combined threshold compensation and data programming phase further comprises placing the fifth switch transistor in an on state to electrically connect the reference voltage supply line to the first plate of the capacitor to apply the reference voltage to the first plate of the capacitor through the fifth switch transistor.

14. The method of operating of claim 13, wherein the pixel circuit further comprises a sixth switch transistor having a first terminal connected to the first voltage supply line and a second terminal connected to the first terminal of the drive transistor; and the emission phase further comprises placing the sixth switch transistor in an on state to electrically connect the first voltage supply line to the first terminal of the drive transistor through the sixth switch transistor.

15. The method of operating of claim 14, wherein the pixel circuit further comprises a seventh switch transistor having a first terminal connected to the first terminal of the light-emitting device and a second terminal connected to the second terminal of the drive transistor; and the emission phase further comprises placing the seventh switch transistor in an on state to electrically connect the first terminal of the light-emitting device to the second terminal of the drive transistor through the seventh switch transistor.

16. The method of operating of claim 15, wherein the pixel circuit further comprises an eighth switch transistor having a first terminal connected to the data voltage supply line and a second terminal connected to the first terminal of the light-emitting device; and each of the initialization phase and the combined threshold compensation and data programming phase further comprises placing the eighth switch transistor in an on state to electrically connect the data voltage supply line to the first terminal of the light-emitting device.

* * * * *